US006165017A

United States Patent [19]

Kuo

[11] Patent Number: 6,165,017

[45] Date of Patent: Dec. 26, 2000

[54] CABLE END CONNECTOR

[75] Inventor: Peter Kuo, Chung-Ho, Taiwan

[73] Assignee: Hon Hai Precision Ind. Co., Ltd., Taipei Hsin, Taiwan

[21] Appl. No.: 09/416,753

[22] Filed: Oct. 13, 1999

[30] Foreign Application Priority Data

Dec. 31, 1998 [TW] Taiwan ..... 87222053

[51] Int. Cl.[7] ..... H01R 13/648

[52] U.S. Cl. ..... 439/610; 439/357

[58] Field of Search ..... 439/610, 357, 439/358, 609, 607

[56] References Cited

U.S. PATENT DOCUMENTS

| | | | |
|---|---|---|---|
| 4,921,441 | 5/1990 | Sauder | 439/610 |
| 5,178,556 | 1/1993 | Chen | 439/357 |
| 5,199,897 | 4/1993 | Hashiguchi | 439/357 |
| 5,199,903 | 4/1993 | Asick et al. | 439/610 |
| 5,201,669 | 4/1993 | Lin | 439/357 |
| 5,244,415 | 9/1993 | Marsilio et al. | 439/610 |
| 5,505,637 | 4/1996 | Kramer et al. | 439/610 |
| 5,836,774 | 11/1998 | Tan et al. | 439/610 |

*Primary Examiner*—Gary F. Paumen
*Attorney, Agent, or Firm*—Wei Te Chung

[57] ABSTRACT

A cable end connector comprises an insulative housing, an upper and lower shells, and an upper and lower covers. The insulative housing defines a number of passageways for receiving terminals therein, the metal shells surrounds the housing for providing protection against electromagnetic interference. A pair of locking elements is formed in a shield surrounding a projection of the housing. The locking elements will engage with corresponding locking slots defined in the shell and the covers for securely retaining the housing and the shells together. The shells conduct static electricity to ground through the locking elements for assuring a reliable signal transmission.

1 Claim, 5 Drawing Sheets

CABLE END CONNECTOR

BACKGROUND OF THE INVENTION

The present invention relates to a cable end connector, and particularly to a cable end connector with a reliable locking element.

Generally, a conventional cable end connector is terminated to a cable for transmitting electrical signals between electrical devices. A reliable cable end connector is required to ensure proper signal transmission. Cables used in long time signal transmission are especially sensitive to external electromagnetic interference.

A conventional cable end connector is disclosed in Taiwan Patent Application No. 84201894. The conventional cable end connector has a metal shield surrounding an insulative housing. An outer shell is provided around the metal shield and the housing. In the conventional cable end connector the metal shield can connect with the insulative housing in two ways. The metal shield has locking elements on both sides of upper and lower surfaces thereof for engaging with locking slots defined in the outer shell and the insulative housing. Alternatively, the locking slots are positioned in the metal shield for receiving locking elements of the insulative housing and the outer shell.

However, the locking elements and locking slots may become permanently deformed after repeated insertions/withdrawals. Also, the conventional cable end connector has no grounding device attached to the metal shield. Thus, static electricity accumulated on the metal shield cannot be discharged to ground thereby adversely affecting signal transmission.

BRIEF SUMMARY OF THE INVENTION

Accordingly, an object of the present invention is to provide a cable end connector having a locking device for securing a shield to an insulative housing and preventing the engaging components from being loosened.

Another object of the present invention is to provide a cable end connector having a locking device with grounding means for conducting static electricity accumulated on a shield to ground.

To fulfill the above mentioned objects, according to a preferred embodiment of the present invention, an electrical card connector has an insulative housing defining a plurality of passageways for receiving corresponding terminals, a metal shield surrounding the insulative housing, and an outer shell. Two pairs of locking elements are positioned on a front side of the insulative housing. The metal shield includes first and lower shells. Each shield has two locking slots for engaging with the corresponding locking elements and ensuring that the first and lower shells are securely assembled to the insulative housing.

DETAILED DESCRIPTION OF THE INVENTION

Figure 1:
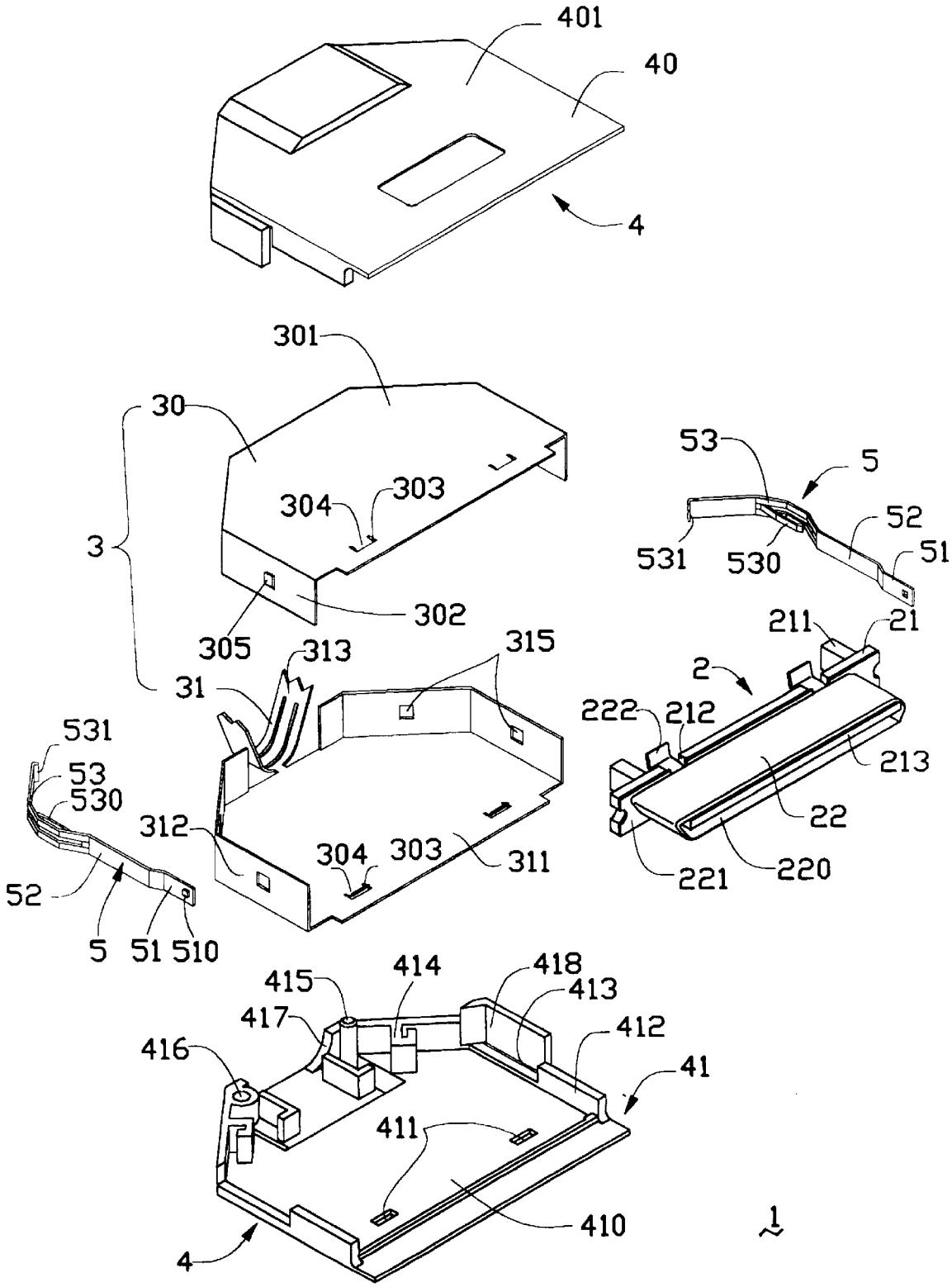
FIG. 1 is an exploded view of a cable end connector of the present invention.
Figure 2:
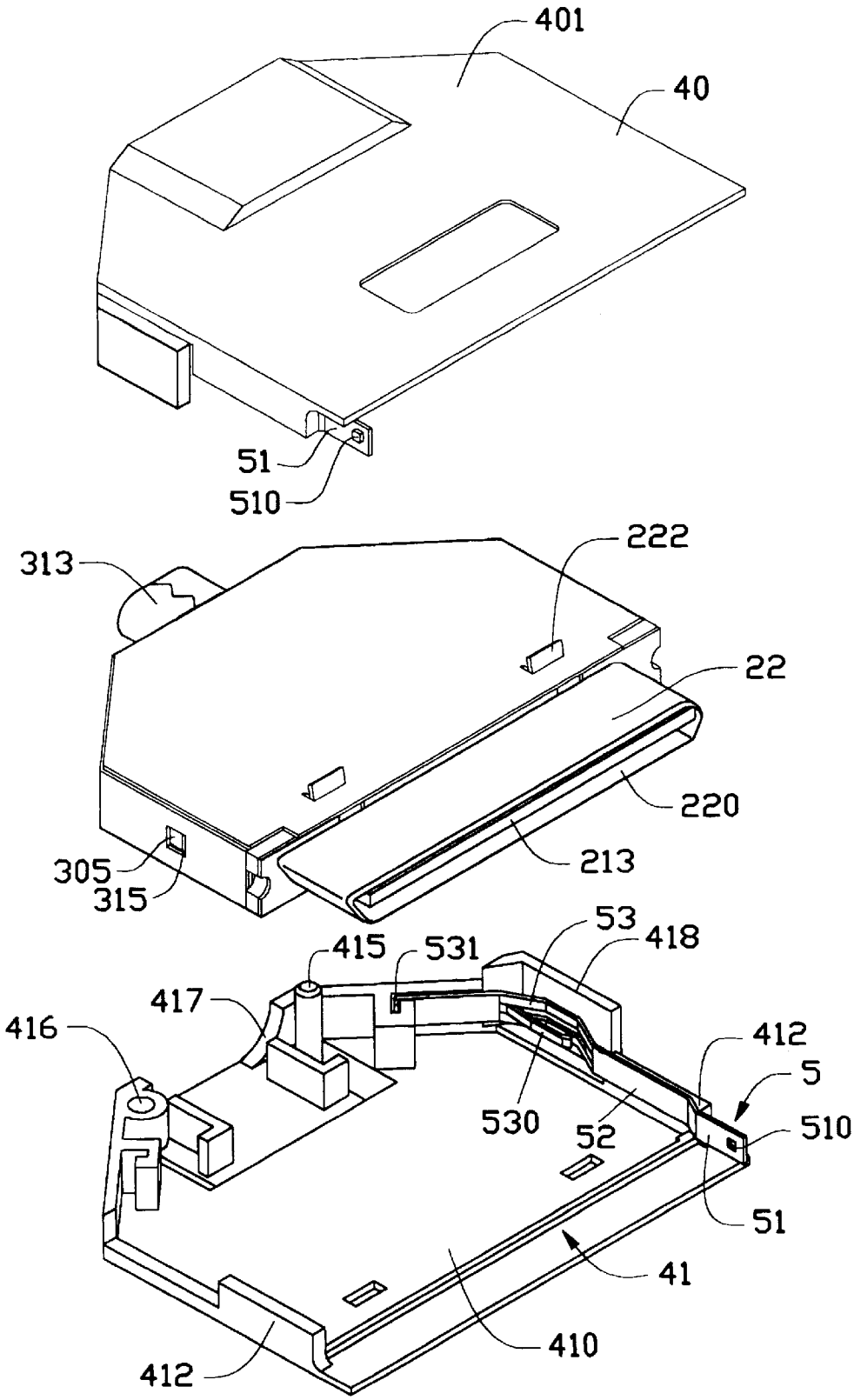
FIG. 2 is a partial assembled view of FIG. 1.

Referring to FIGS. 1 and 2, a cable end connector 1 of the present invention comprises an insulative housing 2, a shell unit 3 and a cover unit 4. The insulative housing 2 includes a body 21, and a shield 22 shrouding a projection 213 of the body 21. A pair of bars 211 rearwardly extends from distal ends of the body 21. A pair of cutouts 212 is formed in each upper and lower edge of the body 21. The projection 213 extends from the body 21 and defines a plurality of passageways for receiving terminals (not shown) therein. The shield 22 forms a receiving cavity 220 for receiving the projection 213 and a positioning wall 221 for abutting against in the body 21. Two pairs of locking elements 222 rearwardly extend from the positioning wall 221 through the cutouts 212. The end of each locking element 222 is bent perpendicularly to the shield 22.

The shell unit 3 comprises an upper shell 30 and a lower shell 31 for receiving the insulative housing 2 therein after assembly. Each shell has a base portion 301, 311 and a pair of side walls 302, 312. Each base portion 301, 311 is vertical to the corresponding side wall 302, 312. Two locking slots 303 are positioned in each bottom wall 301, 311 corresponding to the locking elements 222 of the shield 22. The locking elements 222 engage with the corresponding locking slots 303. A pair of folded plates 304 is positioned in each base portion 301, 311 for contacting an end of the corresponding locking element 222. Thus, the shell unit 3 and the body 2 are prevented from with respect moving to each other while the folded plate 304 can electrically conduct between the shells 30, 31 and the shield 22. Several projections 305 are formed on the side wall 302 of the upper shell 30 for engaging with corresponding locking slots 315 formed in the lower shell 31. When the upper and lower shell 30, 31 are assembled together, the projections 305 engage with the locking slots 315. Furthermore, a locking plate 313 is formed at an end of the lower shell 31 distanced from the locking slots 303 for securing a cable assembly (not shown) therein.

The cover unit 4 includes a upper cover 40 and a lower cover 41 each having a base 401, 410. Each base 401, 410 has an arcuate section 417 for receiving the locking plate 313 and the cable assembly. A side wall 418 is formed an edge of the base 401, 410. A pair of positioning holes 411 is formed in the lower cover 41 for securely engaging with the corresponding locking elements 222. A gap 413 is formed in the side wall 418 and a side plate 412 of the upper and lower covers 40, 41. A locking section 414 projects from the side wall 418 on opposite sides of the arcuate section 417. The base 410 of the lower cover 41 forms a post 415 proximate the locking section 414 on one side of the arcuate section 417, and a receiving hole 416 is defined on the other side of the arcuate section 417. The base 401 of the cover 40 has the same structure as the lower cover 41 but reversed for allowing engagement with each other.

Figure 3:
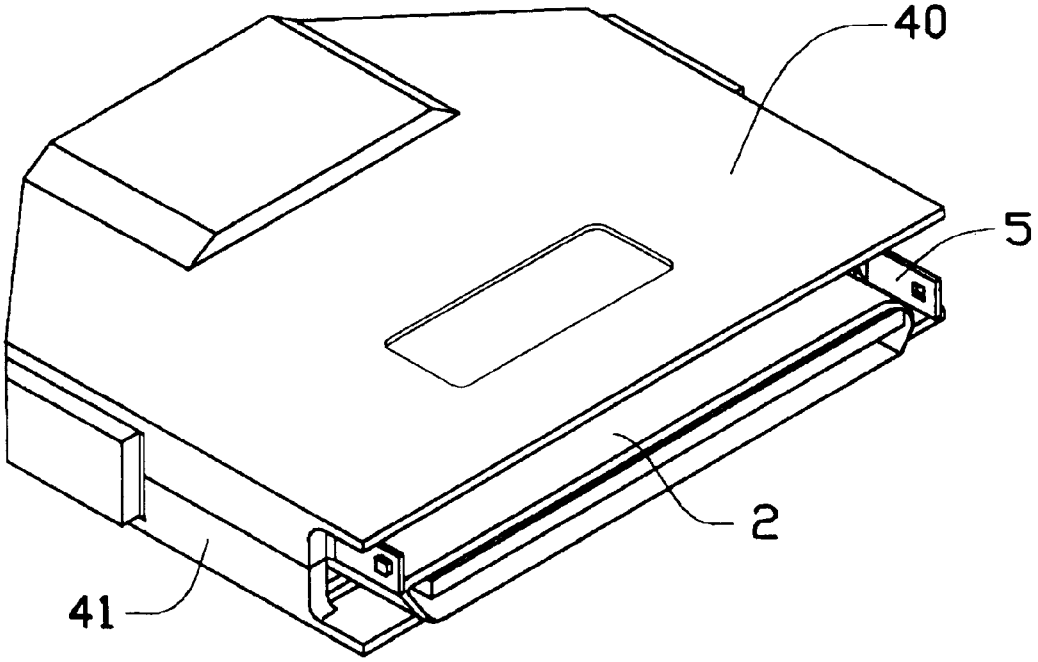
FIG. 3 is a fully assembled view of FIG. 1.
Figure 4:
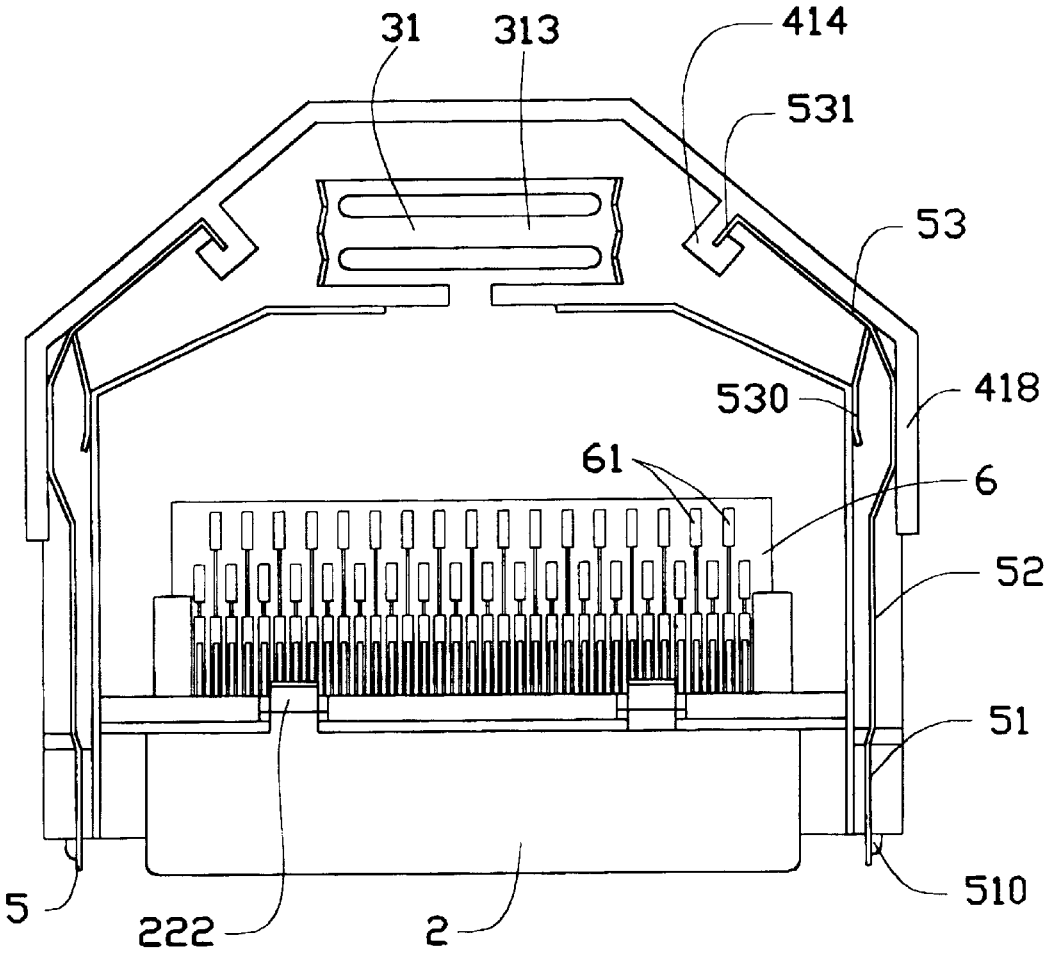
FIG. 4 is a top view of the cable end connector with a shell removed therefrom.

Also, referring to FIGS. 3 and 4, a pair of fixing arms 5 is positioned proximate opposite sides of the upper and lower covers 40, 41 for securely positioning a mating connector (not shown). The fixing arm 5 comprises an engaging section 51, an extending section 52 and a spring section 53. The engaging section 51 has a protrusion 510 for locking with the mating connector. The extending section 52 and the spring section 53 contact the side plate 412 and the side wall 418, respectively. The spring section 53 forms a flexible arm 530 for firmly contacting the side wall 312 and cooperating with the spring section 53 to ensure constant pressure. An angled tip 531 is received in the locking section 414 for ensuring reliable engagement. A circuit board 6 is received in the cover 40 and electrically connected with terminals received in the housing 2. A plurality of solder pads 61 is formed on the circuit board 6. Cable wires are received in the closed locking plate 313 then soldered with the solder pads 61 respectively. Thus, the terminals are electrically connected with the cable wires for signal transmission.

Figure 5:
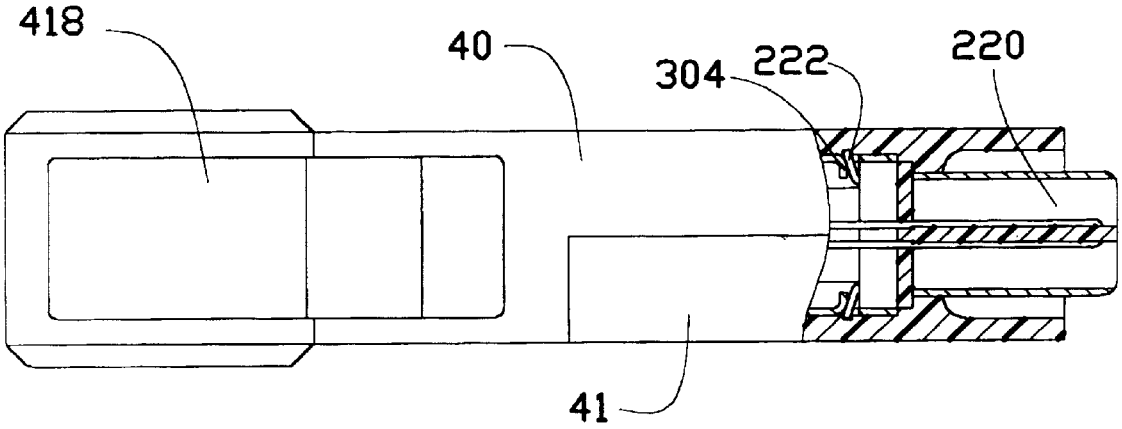
FIG. 5 is a partial cross-sectional view of the cable end connector.

Referring to FIGS. 4 and 5, after the locking elements 222 engage with the locking holes 303, the insulative housing 2 is assembled to the outer shell 3. The spring section 53 and the flexible arm 530 are flexibly deformed whereby the cable end connector will engage with the mating connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable end connector comprising:

an insulative housing having an insulative body and a projection extending from a mating face of the body to form a plurality of passageways;

a shield surrounding the projection of the housing and having two pairs of locking elements rearwardly extending from top and base portions of the shield, respectively;

upper and lower metal shells at least partially surrounding the insulative housing and each shell defining a pair of locking slots engaging with the corresponding locking elements;

upper and lower covers engaging with each other for surrounding the shells therein, each cover comprising a base, a pair of side walls formed on opposite edges of the base, a side plate formed on a lateral edge of the base, and a pair of locking sections projecting from the side walls; and a pair of fixing arms each having an engaging section, a spring section and an extending section, the engaging section and the spring section respectively extending from longitudinal ends of the extending section, a protrusion formed in the engaging section for locking with a mating connector, and the spring section forming a flexible arm for firmly contacting the shells and cooperating with the spring section to ensure constant pressure, an angled tip being received in the corresponding locking section of the lower cover for ensuring reliable engagement with the covers, the fixing arm being retained in a gap formed between the side wall and the side plate of the covers for providing a retaining force to reliably position the shells in the covers;

wherein the upper and lower shells each define a pair of locking slots at lateral sides corresponding to the locking elements;

wherein a plurality of projections is defined in the upper shell for engaging with the corresponding locking slots of the lower shell;

wherein the fixing arms are positioned proximate opposite sides of the upper and lower covers and a protrusion is formed on the engaging section of the fixing arm for engaging with a mating connector;

wherein an angled tip is formed at an end of the fixing arm for engaging with a locking section of the lower cover for providing a retaining force therebetween.

* * * * *